US007735423B1

(12) United States Patent
Gold

(10) Patent No.: US 7,735,423 B1
(45) Date of Patent: Jun. 15, 2010

(54) HIGH VISIBILITY ORDNANCE

(75) Inventor: Kenneth Gold, Allamuchy, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 140 days.

(21) Appl. No.: 11/308,189

(22) Filed: Mar. 10, 2006

(51) Int. Cl.
*F42B 30/08* (2006.01)
*F42B 12/02* (2006.01)

(52) U.S. Cl. ..... 102/473; 102/498; 102/458; 102/459; 102/513

(58) Field of Classification Search ..... 102/458, 102/459, 513, 473, 498
See application file for complete search history.

(56) References Cited

U.S. PATENT DOCUMENTS 2,823,612 A * 2/1958 Cox et al. ..... 244/3.16
2,957,417 A * 10/1960 Musgrave ..... 244/3.16
3,010,677 A * 11/1961 Guthrie et al. ..... 244/3.16
3,122,743 A * 2/1964 Vlasic ..... 342/10
3,137,231 A * 6/1964 Johnson ..... 102/351
3,733,133 A * 5/1973 Chapman ..... 356/141.4
3,757,632 A * 9/1973 Bellinger ..... 89/1.1
4,072,281 A * 2/1978 Miller et al. ..... 244/3.16
4,234,141 A * 11/1980 Miller et al. ..... 244/3.13
4,859,054 A * 8/1989 Harrison ..... 356/5.06
5,372,334 A * 12/1994 Cuadros ..... 244/3.11
6,679,453 B2 * 1/2004 Steiner ..... 244/121
2002/0053278 A1 * 5/2002 Hayes et al. ..... 89/1.34

* cited by examiner

*Primary Examiner*—Bret Hayes
(74) *Attorney, Agent, or Firm*—Michael C. Sachs

(57) ABSTRACT

A munition has an external surface. The munition may be of any type. The external surface includes a coating on at least part of it. Coatings may be, for example, paints, tapes, appliqués or other materials. The coating on the munition includes one or more of reflective material, phosphorescent material and fluorescent material. The reflective, phosphorescent and/or fluorescent coatings are applied to the munition prior to its being deployed. The reflective, phosphorescent and/or fluorescent materials in the coatings are visible at a safe distance from the munition and help to identify unexploded ordnance.

1 Claim, 1 Drawing Sheet

HIGH VISIBILITY ORDNANCE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to ordnance and in particular to detecting unexploded ordnance.

Unexploded ordnance (UXO) is dangerous. UXO includes live unexploded sub-munitions such as bomblets and grenades, artillery rounds, mortar rounds, etc. Locating and destroying UXO is hazardous, costly, and time-consuming. UXO must be rendered safe (usually by destruction in place) when hostilities end to safeguard friendly forces and civilian populations. Detection of UXO is the first step in ensuring that these hazardous items are removed from ranges or are destroyed in place. The primary method of identification of UXO is based on visual sightings. Various factors can interfere with detection, however, such as adverse weather conditions, poor lighting, metal clutter, and tunneling.

SUMMARY OF THE INVENTION

It is an object of the invention to provide ordnance that is highly visible.

It is another object of the invention to provide a method of making ordnance highly visible.

One aspect of the invention is an apparatus comprising a munition having an external surface; and a coating on at least part of the external surface, the coating including reflective material. Preferably, the coating comprises at least one of paint, tape and an appliqué, and the reflective material comprises at least one of microprisms and micro glass beads.

Another aspect of the invention is an apparatus comprising a munition having an external surface; and a coating on at least part of the external surface, the coating including phosphorescent material. Preferably, the coating comprises at least one of paint, tape and an appliqué, and the phosphorescent material comprises at least one of long-glow and short-glow phosphorescent material.

Still another aspect of the invention is an apparatus comprising a munition having an external surface; and a coating on at least part of the external surface, the coating including fluorescent material. Preferably, the coating comprises at least one of paint, tape and an appliqué.

Yet another aspect of the invention is an apparatus comprising a munition, at least part of the munition comprising a substance that includes at least one of phosphorescent material, fluorescent material and reflective material.

A further aspect of the invention is a method comprising supplying a munition having an exterior surface; and coating at least a portion of the exterior surface of the munition with a substance that includes one of phosphorescent material, fluorescent material and reflective material.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
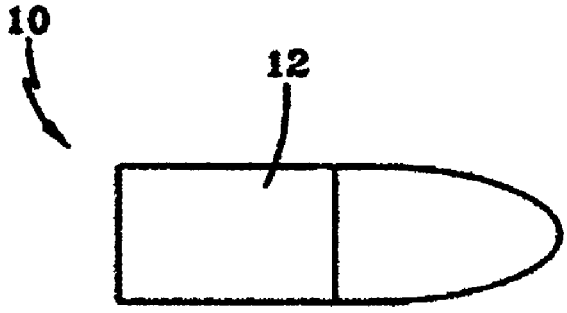
FIG. 1 schematically shows a munition.

The invention encompasses a munition 10, schematically shown in FIG. 1, having an external surface 12. The munition 10 may be of any type. The external surface 12 includes a coating on at least part of it. Coatings may be, for example, paints, tapes, appliqués or other materials. The coating on the munition 10 includes one or more of reflective material, phosphorescent material and fluorescent material. The reflective, phosphorescent and/or fluorescent coatings are applied to the munition 10 prior to its being deployed. The reflective, phosphorescent and/or fluorescent materials in the coatings are visible at a safe distance from the munition 10. Observations may be made by eye or with sensitive optical equipment.

Figure 2A:
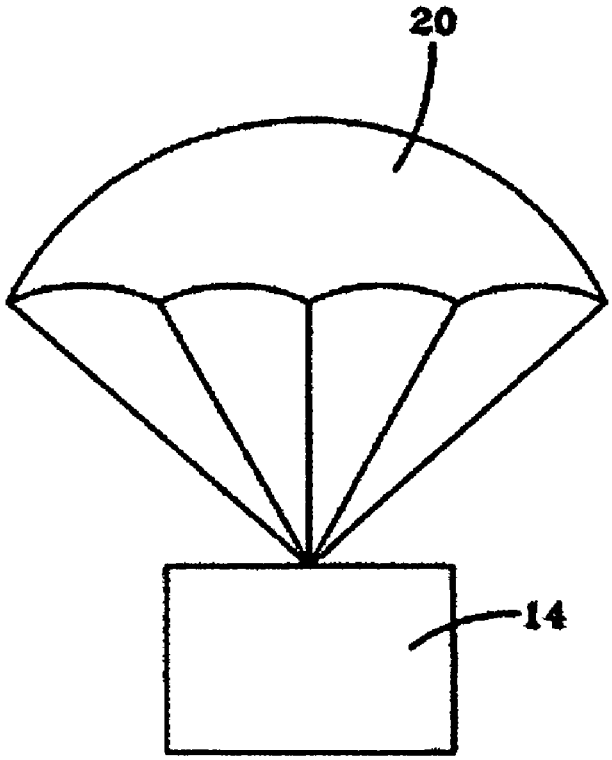
FIG. 2A schematically shows another embodiment of a munition.
Figure 2B:
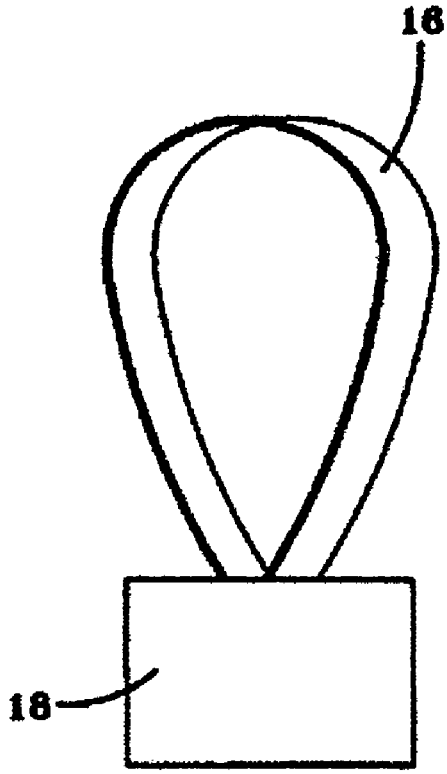
FIG. 2B schematically shows a further embodiment of a munition.

Some munitions, such as submunitions, include components such as a parachute, ribbon, fin or vane that may be used in arming the submunition. Rather than coating these components, the component itself may be manufactured from a material that includes at least one of phosphorescent material, fluorescent material and reflective material. FIG. 2A shows a parachute 20 attached to a munition 14. FIG. 2B shows a ribbon 16 attached to a munition 18.

Reflective materials only reflect light when they are activated with light. Sunlight, white light and IR light are examples of activators for reflective material. The reflective material may comprise, for example, microprisms and/or micro glass beads. Light reflected from microprisms can be detected by eye or with optical equipment. A simple and low cost method is to incorporate micro glass beads (or other reflective material) into paints currently used on ordnance. The optimal ratio of beads to liquid coating will vary depending on the particular munition and its use.

A suspension of glass beads ranging in size from 1 to approximately 50 microns is prepared by adding the beads to a clear polyurethane base. A 10% (by weight) suspension is a useful starting point when preparing the suspension for application by brush. Apply repeated coatings after drying to obtain the desired reflective effect. The preferred application technique is to use the minimum amount of material needed to obtain the desired effect. The suspension can also be sprayed on the surface of the item. Repeat spraying after the surface dries until the desired reflective effect is obtained. An alternative is to use a mixture of glass beads having known diameters. Mix equal parts of the beads to achieve a similar range (1-50 microns) and use the same application processes as described above.

Reflective materials such as glint tape and glow tape may be applied to the external surface of the munition. Microprism appliqués for use as light-reflective markers may be applied to the external surface of the munition. Such microprism appliqués are used on school buses, agricultural vehicles, and other slow moving vehicles (i.e., construction vehicles).

Microprism appliqués illuminated with infrared wavelengths were studied and found to be highly effective reflectors. A strip of retroreflective tape having dimensions of approximately 1×5 centimeters stood out brightly when viewed in darkness with night vision goggles and also when recorded with a camcorder equipped with IR and low light photographic capabilities. The test strip contained approximately 12,000 microprisms (Reflexite® microprisms) arranged linearly. Retroreflective tapes were also highly visible in photographs taken with flash. Various configurations of microprisms for retroreflective films are available from different manufacturers. To achieve optimum reflectivity for specific applications, the dimensions of the appliqué and the configuration of the microprisms can be varied.

Phosphorescent materials will continue to emit light for a period of time after activation. The cheapest way to activate phosphorescent materials is with bright sunlight. Alternative activators include UV light or other suitable light sources rich in UV energy (e.g., black light, halogen lamps, xenon lamp, etc.). Some phosphorescent materials will glow for hours following activation. UV light charges the phosphors extremely rapidly.

The human eye is highly sensitive to the wavelengths emitted by certain phosphorescent pigments and, therefore, special light-intensifying equipment may not always be required. Viewing by eye may suffice for hours after phosphorescent pigments are activated. It is well known that the length of the afterglow period can be varied, such as by adjusting the powder to binder ratio, optimizing the wavelength and intensity of light used to activate the pigment, or lengthening the illumination period. The glow from some varieties of phosphorescent pigments can last for 12 hours or longer after they have been charged. A distinct advantage of phosphorescent pigments is that they can be recharged repeatedly in situ until they are destroyed or inactivated by natural environmental conditions or by artificial means.

The phosphorescent material may be either long-glow and/or short-glow phosphorescent material. Long-glow phosphorescent material may glow for 12 or more hours after being charged by light. The effects of selected sources of illumination on the brightness of the phosphorescent material LumiNova® are summarized in Table 1. As the luminous intensity of the light source increases, the activation time to saturation of the phosphorescent material decreases.

TABLE 1

How Light Affects Brightness.

| Light Source | Luminous Intensity (Lux) | Excitation Time to Saturation (minutes) |
|---|---|---|
| Sunlight, Clear | >50,000 | 5 |
| Sunlight | 3,000-50,000 | 5 |
| Dusk | 1,000 | 8 |
| Fluorescent | 500 | 10 |

3M is an additional commercial supplier of phosphorescent materials. (See, for example, 3M Product Bulletin 6900, entitled Luminous Film 6900, June 2002, for applications of luminous film for safety signage.)

Phosphorescent pigments are incorporated into the paint coating of the munition and applied to selected areas/components of the munition. Thus, UXO can have specific glow-in-the-dark (luminescent) signatures that vary depending on the nature of the specific phosphor as well as the patterns that are applied when coating the munition. Both short-glow (for example, ZnS:Cu) and long-glow phosphorescent pigments (doped strontium oxide aluminate pigments) may be used. Short-glow pigments and coatings may be cheaper. An exemplary mixture is a ten to six weight ratio of long-glow phosphorescent pigment powder (LumiNova® G300M) and polyurethane coating.

Fluorescent materials emit light only while being activated by ultra-violet (UV) light.

Fluorescent materials added to coatings or used as dyes in fabrics provide strong signals when illuminated with UV (black light). In contrast to phosphorescent substances, fluorescent materials that absorb UV and emit blue light do so only when the UV source is directed toward the object. Fluorescent materials provide high visibility for fabrics such as those used for parachutes, ribbons, etc. Testing has shown that a fluorescent powder (e.g., an off-the-shelf laundry brightener) mixed with a clear satin finish polyurethane base (1 tsp powder: approx. 1 oz. base) and applied to a metal part provides a strong fluorescent signal. It is important that the base that is mixed with fluorescent powders is UV transparent, so that the UV light can penetrate to the fluorescent material.

Searching for UXO may be done from an airborne platform. A helicopter may be used for visual sightings or for mounting sensitive optical equipment. An unmanned aircraft with optical equipment on board may be used to produce recordings. The recordings can be radio transmitted and examined or examined when the unmanned aircraft returns to base. Light signals that are indicative of ordnance may be plotted by GPS coordinates. The UXO can then be slated for destruction. Unique signatures (distinctive wavelengths or special patterns) may be used to differentiate between UXO and inert rounds (such as used on a test range).

UXO that is lying on the surface of a test range is the easiest to locate and destroy. The light signals and patterns that are emitted or reflected are characteristic of the material applied to the ordnance. Detection under these circumstances is anticipated to be straightforward.

Ordnance that penetrates the surface of a test range is more difficult to locate. The detection and elimination of ordnance that has penetrated test range surfaces is one of the most challenging clean-up issues. Sacrificial coatings designed to be stripped from the surface of ordnance at the onset of a tunneling event leave reflective, phosphorescent and/or fluorescent residues at the surface point of entry. The residues may be detected using the same lighting conditions and observation techniques described for above-ground UXO.

Identifying and plotting the locations of UXO may be accomplished at night time using the naked eye or sensitive light-gathering instruments. Aerial surveillance over known target areas using spotlights is useful for detection. Under some conditions, vehicle-mounted spotlights may also serve as sources of illumination.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. Means for locating an unexploded explosive munition, comprising:

Means to project ultraviolet black light towards an exterior surface of said unexploded munition a fluorescent coating applied to at least a portion of the exterior surface of the unexploded munition such that the coated portion of the exterior surface of the unexploded munition shows blue light in response to the ultraviolet black light so as to indicate presence of the unexploded munition, and wherein the fluorescent coating comprises fluorescent powder mixed with a clear satin finish polyurethane base.

* * * * *